US010859343B1

(12) United States Patent
Glen

(10) Patent No.: US 10,859,343 B1
(45) Date of Patent: Dec. 8, 2020

(54) MAGAZINE WELL FOR A FIREARM

(71) Applicant: AGENCY ARMS, LLC, Ventura, CA (US)

(72) Inventor: Kevin Glen, Ventura, CA (US)

(73) Assignee: AGENCY ARMS, LLC, Ventura, CA (US)

( * ) Notice: Subject to any disclaimer, the term of this patent is extended or adjusted under 35 U.S.C. 154(b) by 0 days.

(21) Appl. No.: 16/850,455

(22) Filed: Apr. 16, 2020

Related U.S. Application Data

(60) Provisional application No. 62/848,934, filed on May 16, 2019.

(51) Int. Cl.
*F41C 23/10* (2006.01)
*F41C 23/16* (2006.01)

(52) U.S. Cl.
CPC ..... *F41C 23/16* (2013.01); *F41C 23/10* (2013.01)

(58) Field of Classification Search
CPC ..... F41C 23/16; F41C 23/10; F41A 17/38; F41A 9/61; F41A 9/65
USPC ..... 42/90, 6, 7
See application file for complete search history.

(56) References Cited

U.S. PATENT DOCUMENTS

| | | | | |
|---|---|---|---|---|
| 4,570,370 | A * | 2/1986 | Smith | F41C 23/10 42/7 |
| 5,052,140 | A * | 10/1991 | Smith | F41C 23/10 42/7 |
| 7,743,542 | B1 * | 6/2010 | Novak | F41C 23/10 42/7 |
| 9,897,402 | B2 * | 2/2018 | Pettit | F41A 19/11 |
| 10,066,885 | B2 * | 9/2018 | Chen | F41A 9/65 |
| 10,101,105 | B1 * | 10/2018 | Novak | F41A 35/00 |
| 2010/0154275 | A1 * | 6/2010 | Faifer | F41A 35/00 42/90 |
| 2013/0139426 | A1 * | 6/2013 | Baxley | F41C 23/10 42/71.02 |
| 2017/0205188 | A1 * | 7/2017 | Chavez | F41C 23/10 |

* cited by examiner

*Primary Examiner* — Reginald S Tillman, Jr.
(74) *Attorney, Agent, or Firm* — Eversheds Sutherland (US) LLP

(57) ABSTRACT

A magazine well configured to be attached to a firearm is disclosed herein. The magazine well comprising a base, a flexible tab extending from the base, and a detent disposed on the flexible tab. The detent is configured to engage a notch in the firearm in order to secure the magazine well to the firearm.

20 Claims, 14 Drawing Sheets

MAGAZINE WELL FOR A FIREARM

CROSS-REFERENCE TO RELATED APPLICATIONS

The disclosure claims priority to and the benefit of U.S. provisional application No. 62/848,934, filed May 16, 2019, which is hereby incorporated by reference herein in its entirety.

FIELD

The disclosure generally relates to a magazine well and more particularly to a flexible magazine well.

BACKGROUND

Magazine wells, or magwells, are generally an aftermarket accessory for firearms that modify the base of a firearm grip (e.g., a pistol grip). Specifically, the magazine well may be secured onto the base of the firearm grip, which may provide several benefits, including improving the consistency of where and how a user holds the firearm. For example, the magazine well may generally have a larger perimeter than the firearm grip. The larger perimeter may enable the user of the firearm to quickly and efficiently feel where to insert or remove the magazine—which may be beneficial for competition shooting and/or durability.

While magazine wells can improve several aspects of a firearm, poorly designed magazine wells can have adverse effects, resutling in a number of problems. For instances, a poorly designed magazine well may prevent a magazine from being fully inserted into the firearm. In addition, poorly positioned securing mechanisms (e.g., the fasteners) may come loose over time, resulting in a magazine well that wobbles and potentially detaches during discharge of the firearm.

BRIEF DESCRIPTION OF THE DRAWINGS

The detailed description is set forth with reference to the accompanying drawings. The use of the same reference numerals may indicate similar or identical items. Various embodiments may utilize elements and/or components other than those illustrated in the drawings, and some elements and/or components may not be present in various embodiments. Elements and/or components in the figures are not necessarily drawn to scale. Throughout this disclosure, depending on the context, singular and plural terminology may be used interchangeably.

DETAILED DESCRIPTION

Overview

The disclosure is generally directed to a magazine well that is configured to flexibly attach to a firearm grip. For example, the magazine well may include a first tab, a second pliable tab, a continuous wall, and a detent disposed on the second pliable tab. The continuous wall, the first tab, and the second pliable tab are configured to flexibly receive a portion of the firearm grip, and the detent is configured to snap within a notch in the firearm grip. The magazine well can be flexibly switched between an engaged configuration (e.g., attached to the firearm grip) and a disengaged configuration (e.g., unattached from the firearm grip).

Illustrative Embodiments

Figure 1A:
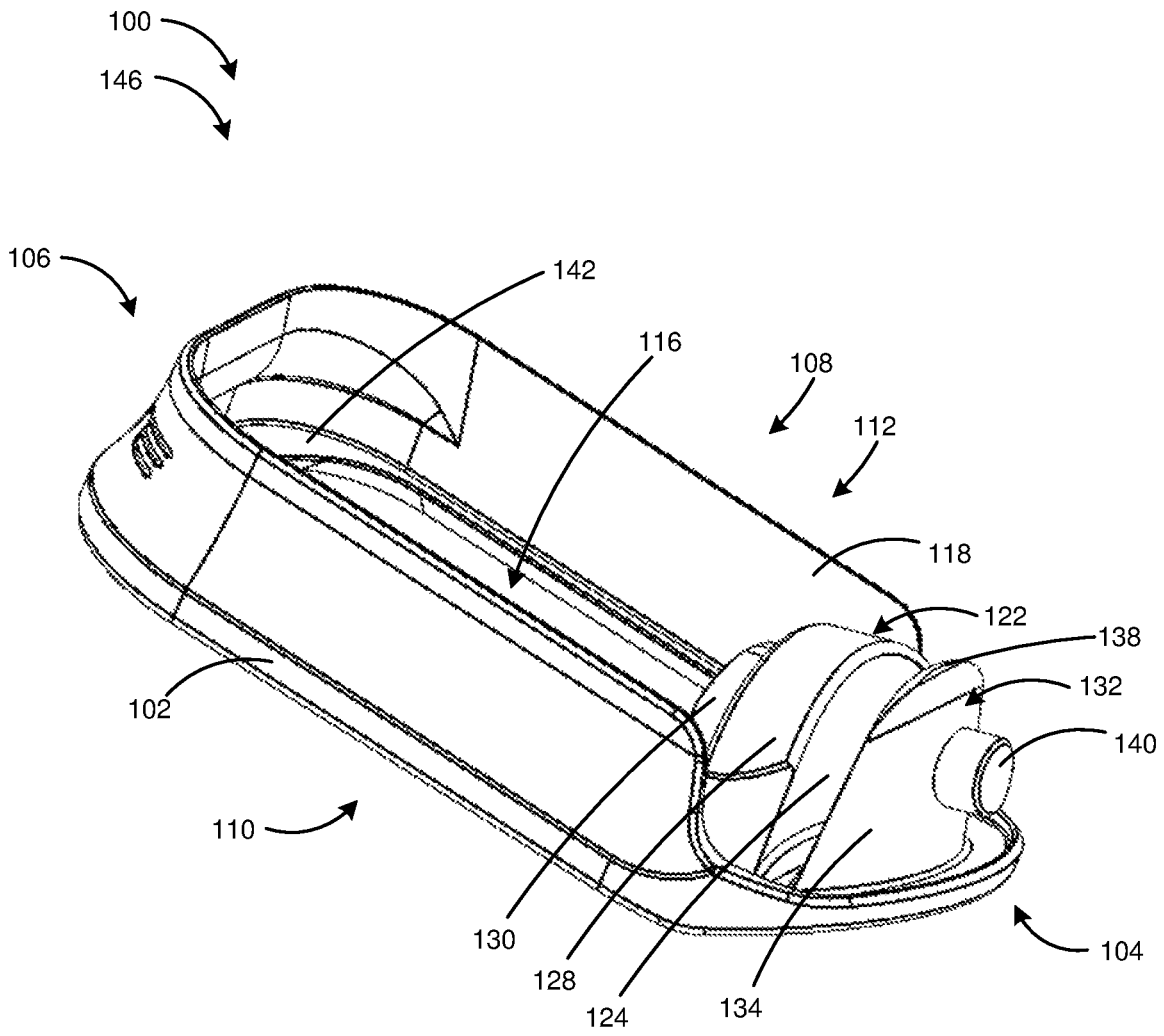
FIG. 1A depicts a rear perspective view of a magazine well for a firearm in accordance with one or more embodiments of the disclosure.
Figure 2A:
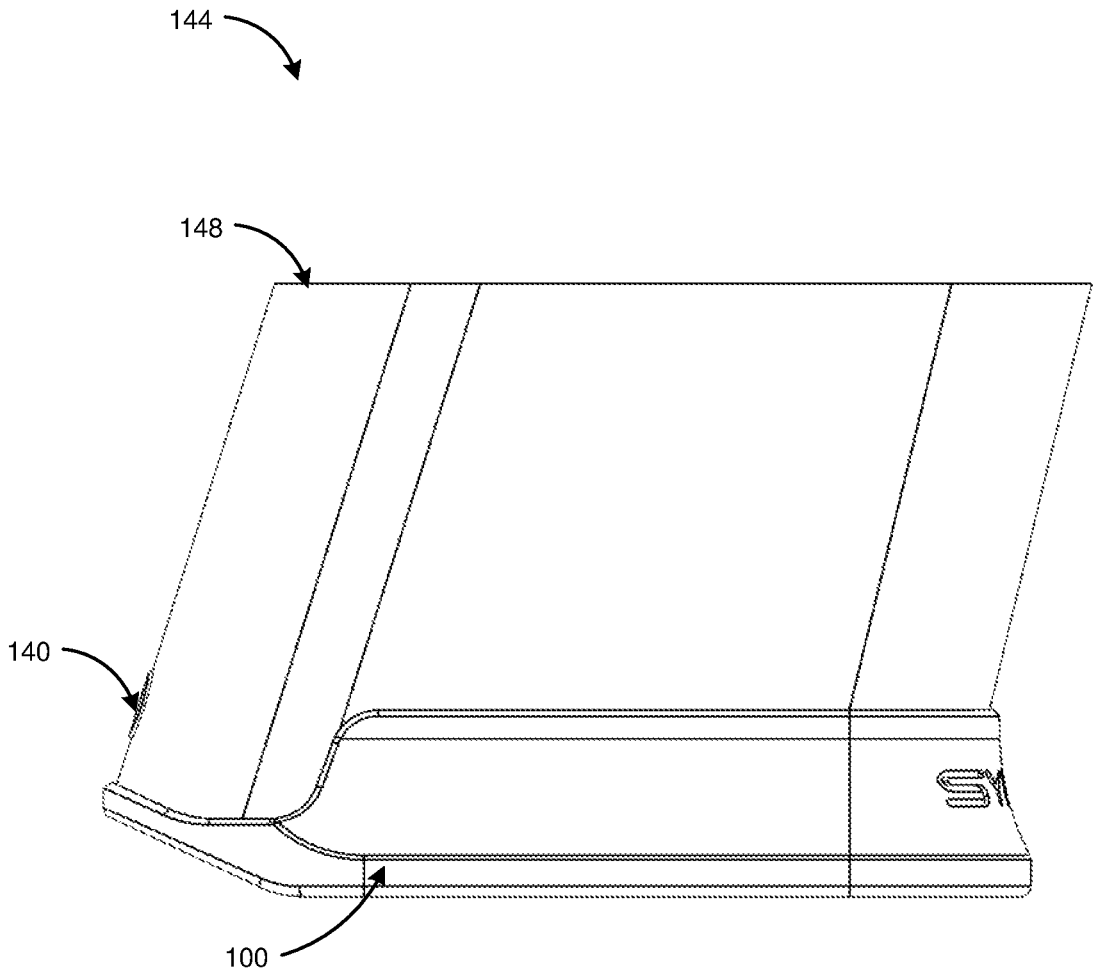
FIG. 2A depicts a side view of a magazine well in an attached configuration with a firearm grip in accordance with one or more embodiments of the disclosure.
Figure 2B:
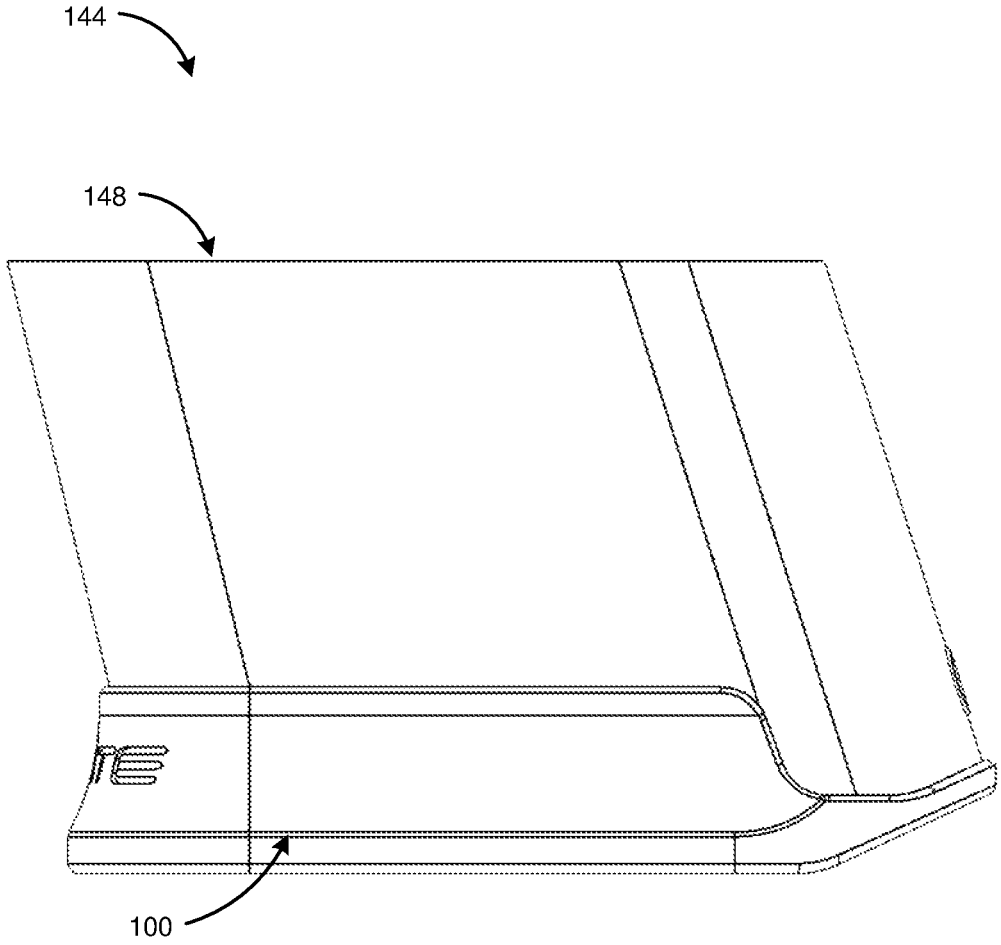
FIG. 2B depicts a side view of the magazine well in the attached configuration in accordance with one or more embodiments of the disclosure.

FIG. 1A depicts a rear perspective view of a magazine well 100 for a firearm in accordance with one or more embodiments of the disclosure. The magazine well 100 can include a base 102 with a proximate end 104, a distal end 106, a first side 108, a second side 110, a top side 112, and bottom side 114. In some instances, the base 102 is substantially flat between the distal end 106 and the proximate end 104. In one example, the base 102 is configured to complement a curvature of the firearm grip 148 (e.g., as shown in FIG. 2A). For example, the curvature of the firearm grip 148 can include a flat surface disposed along the base 102, which angles away from the flat surface at one end (e.g., the proximate end 104) to complement a similar pattern on the firearm grip. Further, the base 102 can include a pill-shaped perimeter where the first side 108 and the second side 110 are flat and the proximate end 104 and the distal end 106 are arcuate. The base 102 can be any suitable size, shape, or configuration. For example, the base 102 can be rectangular, triangular, square, circular, or some other geometry.

Figure 1B:
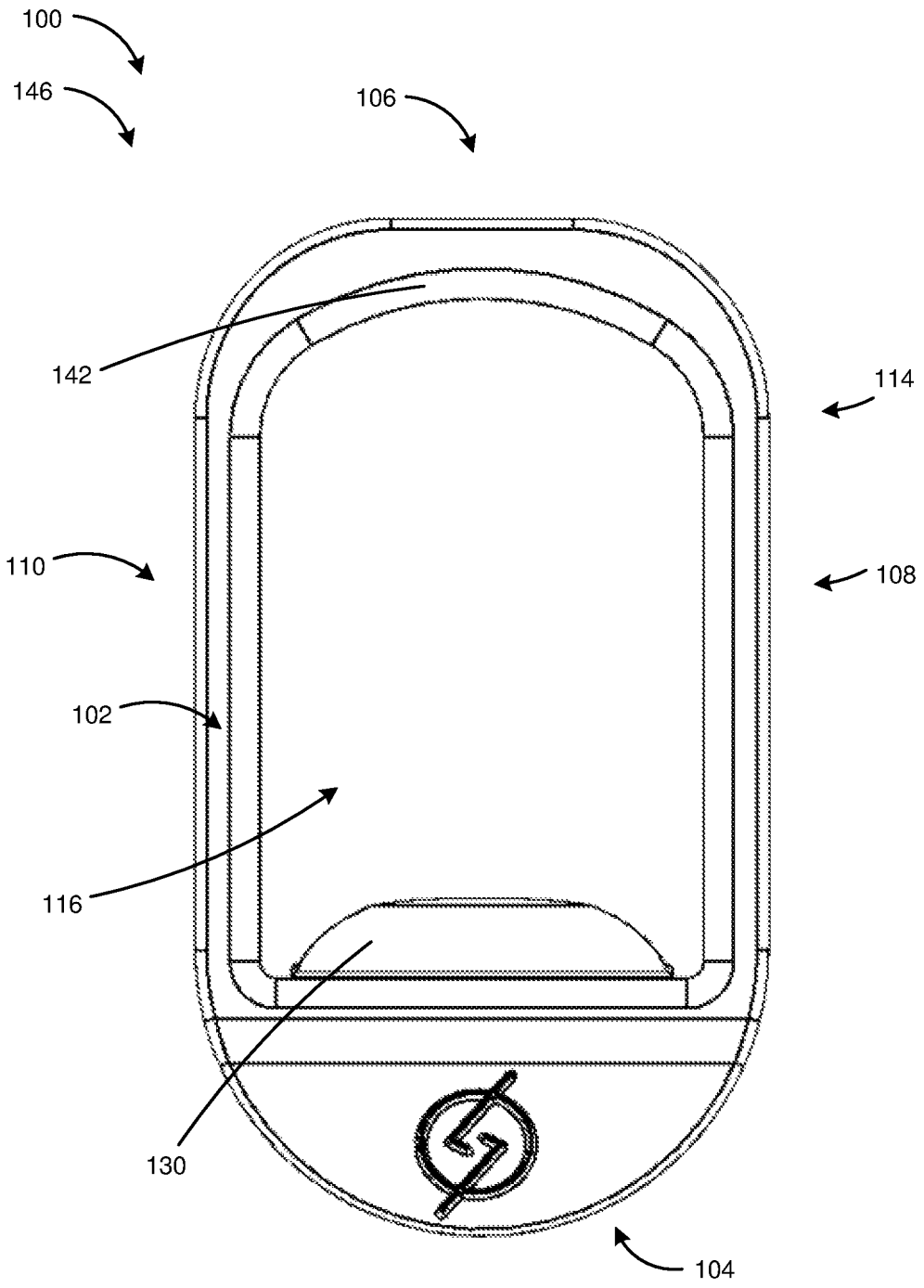
FIG. 1B depicts a bottom view of the magazine well in accordance with one or more embodiments of the disclosure.
Figure 1C:
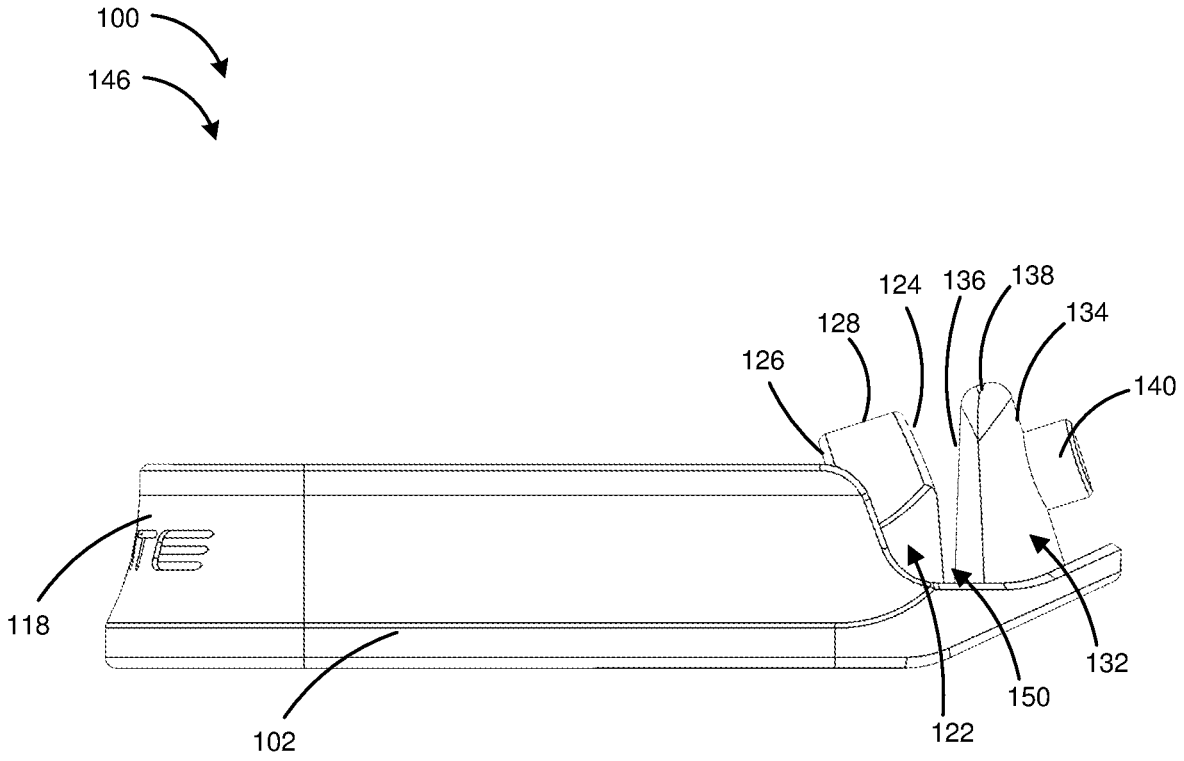
FIG. 1C depicts a side view of the magazine well in accordance with one or more embodiments of the disclosure.
Figure 1D:
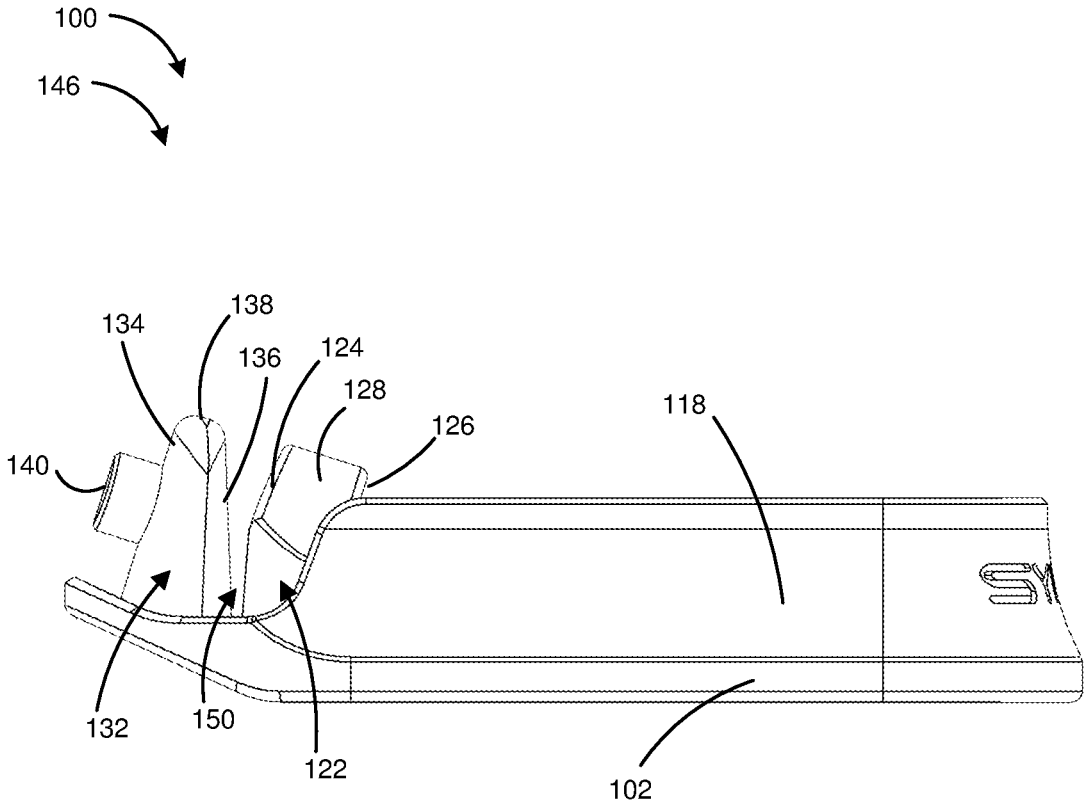
FIG. 1D depicts a side view of the magazine well in accordance with one or more embodiments of the disclosure.
Figure 1E:
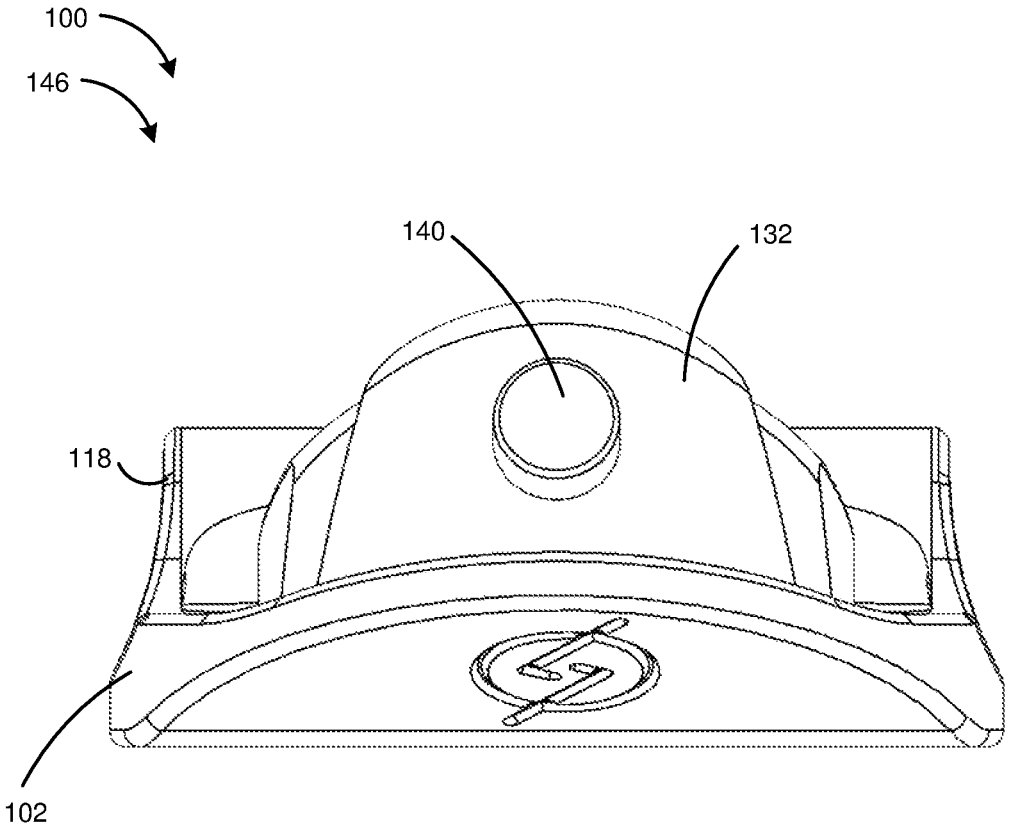
FIG. 1E depicts a rear view of the magazine well in accordance with one or more embodiments of the disclosure.
Figure 1F:
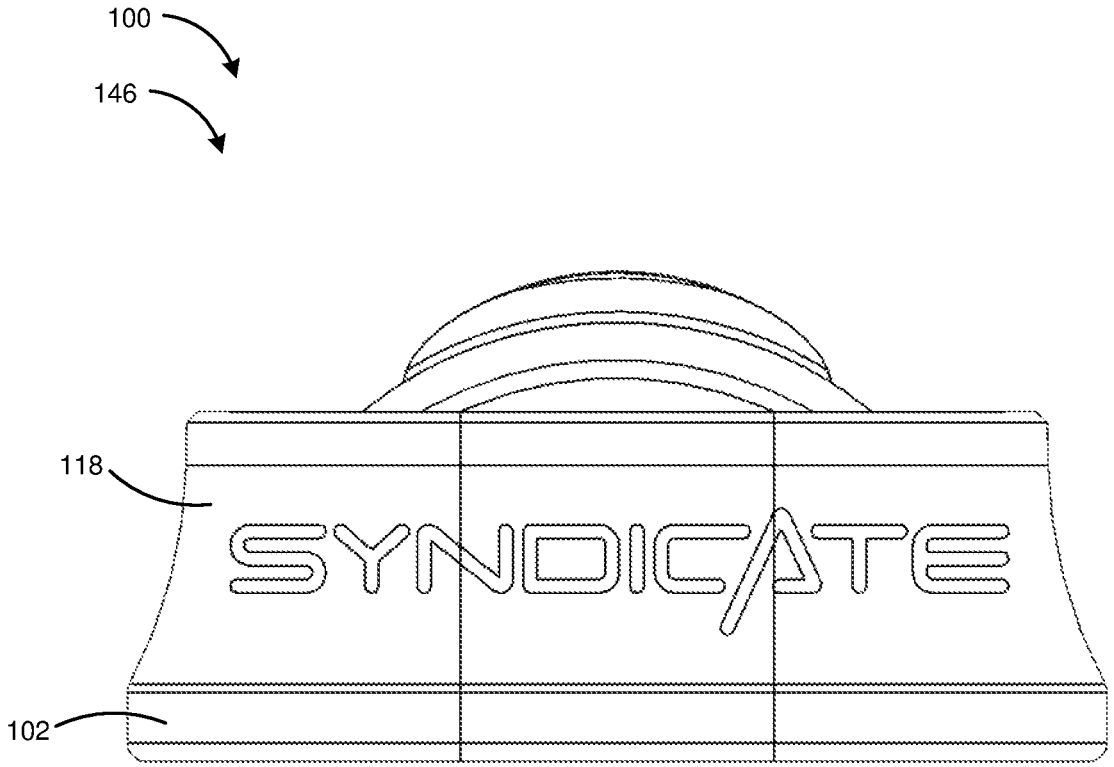
FIG. 1F depicts a front view of the magazine well in accordance with one or more embodiments of the disclosure.

In some embodiments, as shown in FIG. 1B, a wall 118 extends from the base 102. The wall 118 may extend from the perimeter of the base 102. The wall 118 may be continuous and extend along the entire perimeter of the base 102, or the wall 118 may extend along a portion of the perimeter of the base 102. The wall 118 may be any suitable size, shape, or configuration.

The wall 118 and the base 102 may form a magazine aperture 116. The magazine aperture 116 may extend between the top side 112 and the bottom side 114 of the base 102. In one example, the magazine aperture 116 complements the shape of the base 102. In another example, the magazine aperture 116 may substantially complement the shape of the base 102 but have one or more sides that do not complement the perimeter of the base 102. In some instances, the magazine aperture 116 can be pill-shaped and configured to receive an original equipment manufacturer magazine (e.g., a GLOCK® 9 mm magazine from any model year). In one example, the magazine aperture 116 may complement another shape for another type of firearm. For example, the magazine well 100 can be configured to secure onto an AR-15 weapons system, and the magazine aperture 116 may be rectangular. The magazine aperture 116 may be any suitable size, shape, or configuration. For example, the magazine aperture 116 can be rectangular, circular, triangular, or some other geometry.

In some embodiments, as shown in FIGS. 1A-1H, the wall 118 comprises a continuous wall 118 projecting along the base 102. In one example, the continuous wall 118 projects outward from the base 102 away from the bottom side 114 towards the top side 112. In certain examples, the continuous wall 118 begins adjacent to the proximate end 104 of the base 102, traces the base 102 to the distal end 106 on the first side 108, lines the distal end 106, and then extends along the second side 110 towards the proximate end 104. In this manner, the continuous wall 118 may form a U-shape. In other examples, the continuous wall 118 projects from the proximate end 104, the distal end 106, the first side 108, and the second side 110. In yet other examples, the continuous wall 118 projects from one or more sides.

Figure 1G:
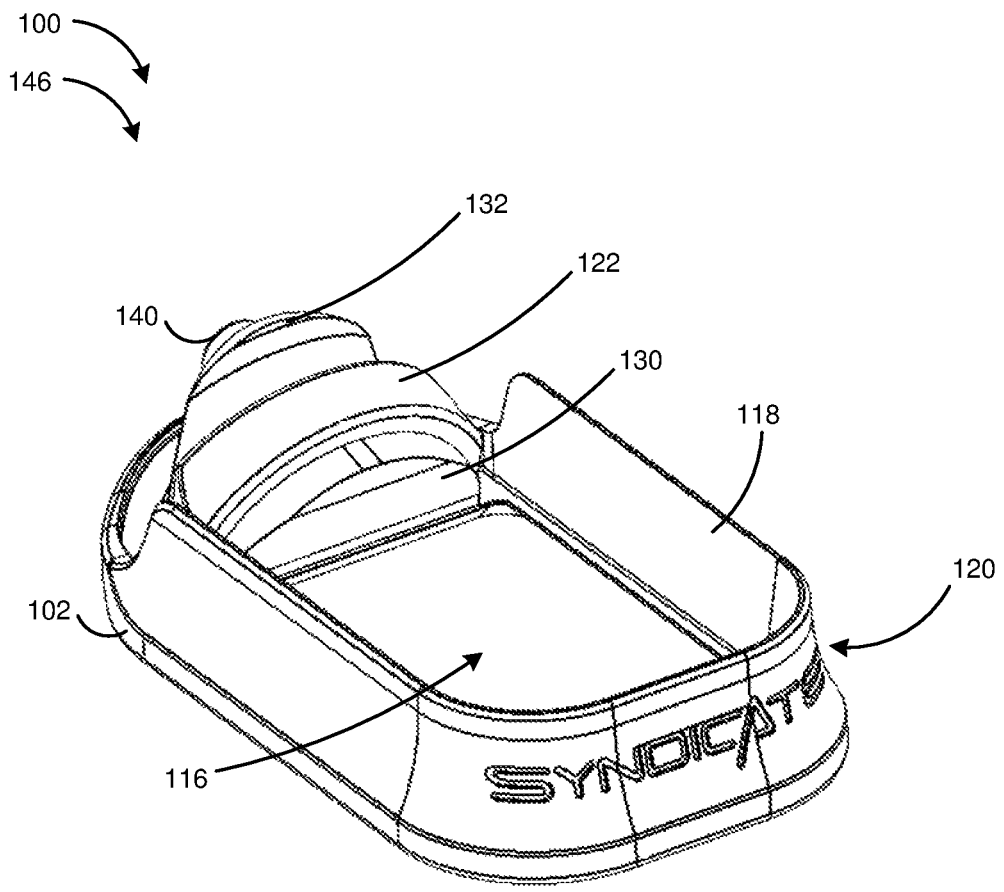
FIG. 1G depicts a front perspective view of the magazine well in accordance with one or more embodiments of the disclosure.

In some embodiments, as shown in FIG. 1G, the continuous wall 118 can include a bevel 120. In one example, the bevel 120 can substantially align with the firearm grip 148 (e.g., as shown in FIG. 2A) at a top end of the continuous wall 118. The bevel 120 can extend arcuately from the top end of the continuous wall 118 towards the bottom end of the continuous wall 118 so as to flare outward from the firearm grip 148. In other embodiments, the bevel 120 can slant in one or more directions. For example, the bevel 120 can extend at a 45-degree angle from the top end of the continuous wall 118 towards the base 102. The bevel 120 can be any suitable size, shape, or configuration. For example, the bevel 120 can extend at an angle greater than or less than 45 degrees and/or be any arcuate shape.

Figure 1H:
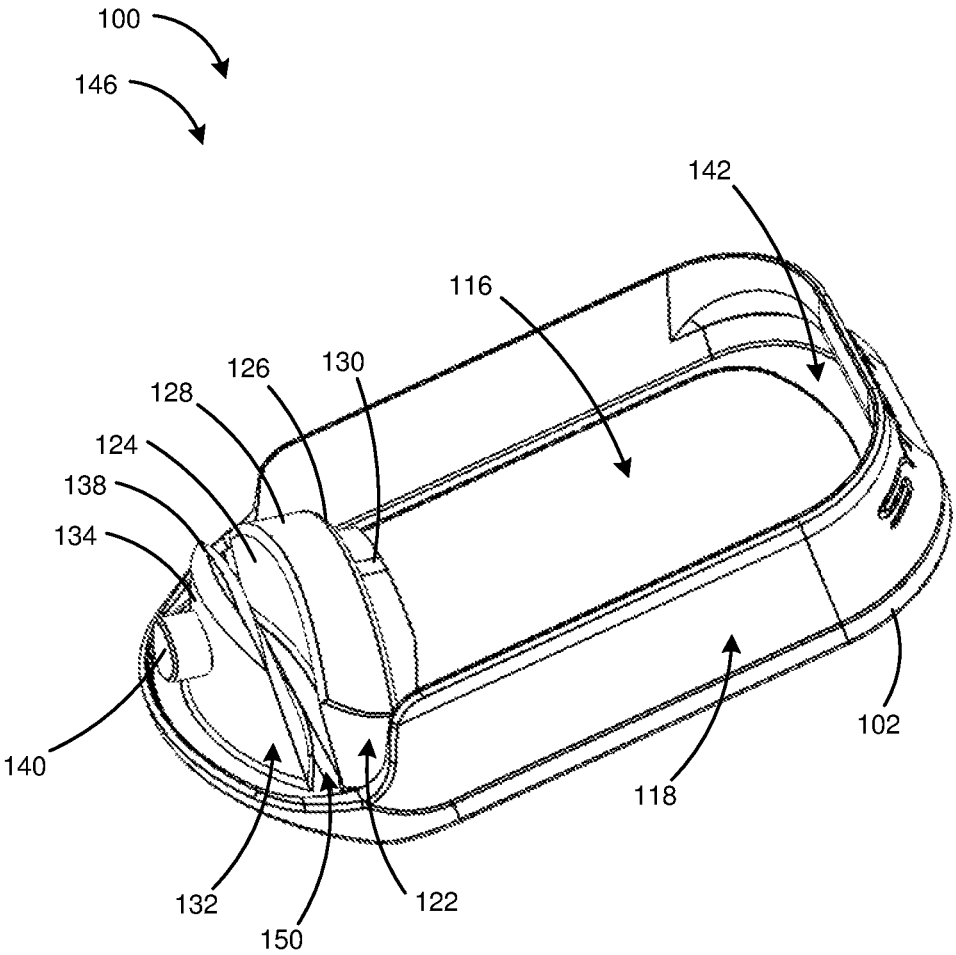
FIG. 1H depicts a rear perspective view of the magazine well in accordance with one or more embodiments of the disclosure.
Figure 2C:
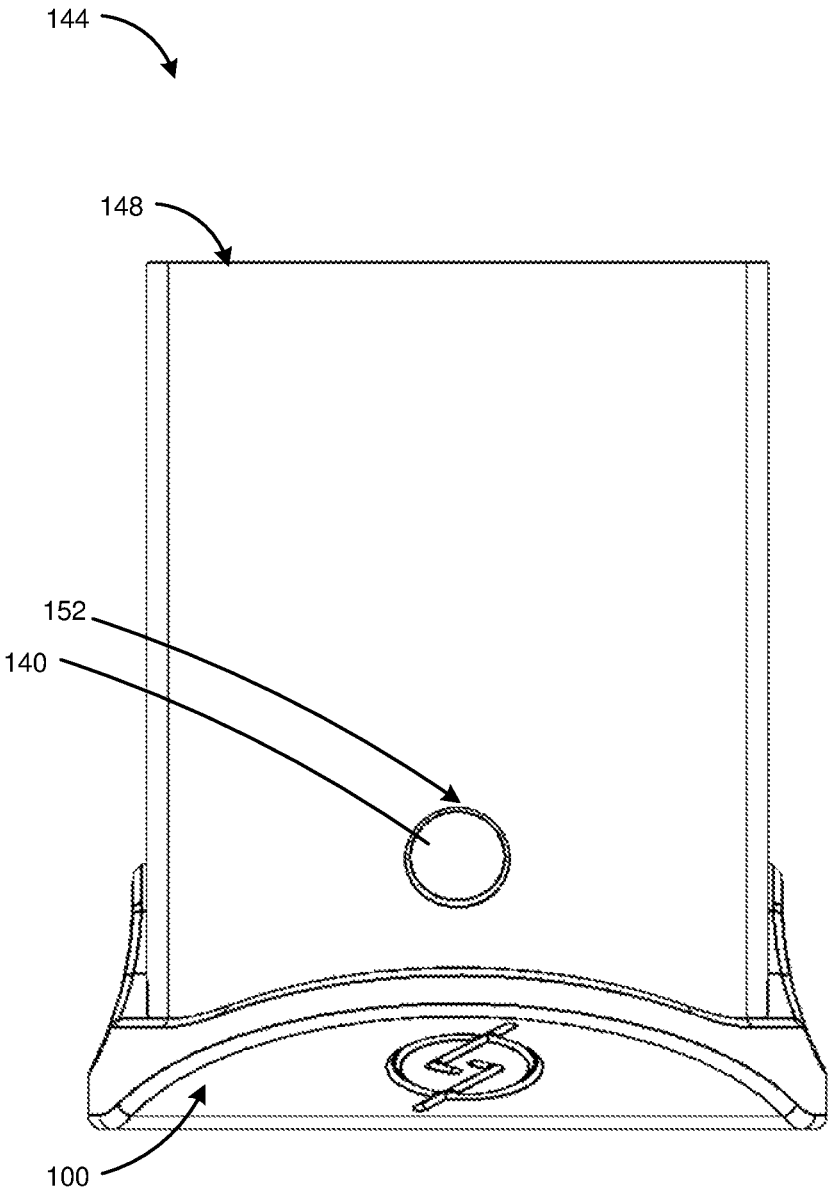
FIG. 2C depicts a rear view of the magazine well in the attached configuration in accordance with one or more embodiments of the disclosure.
Figure 2D:
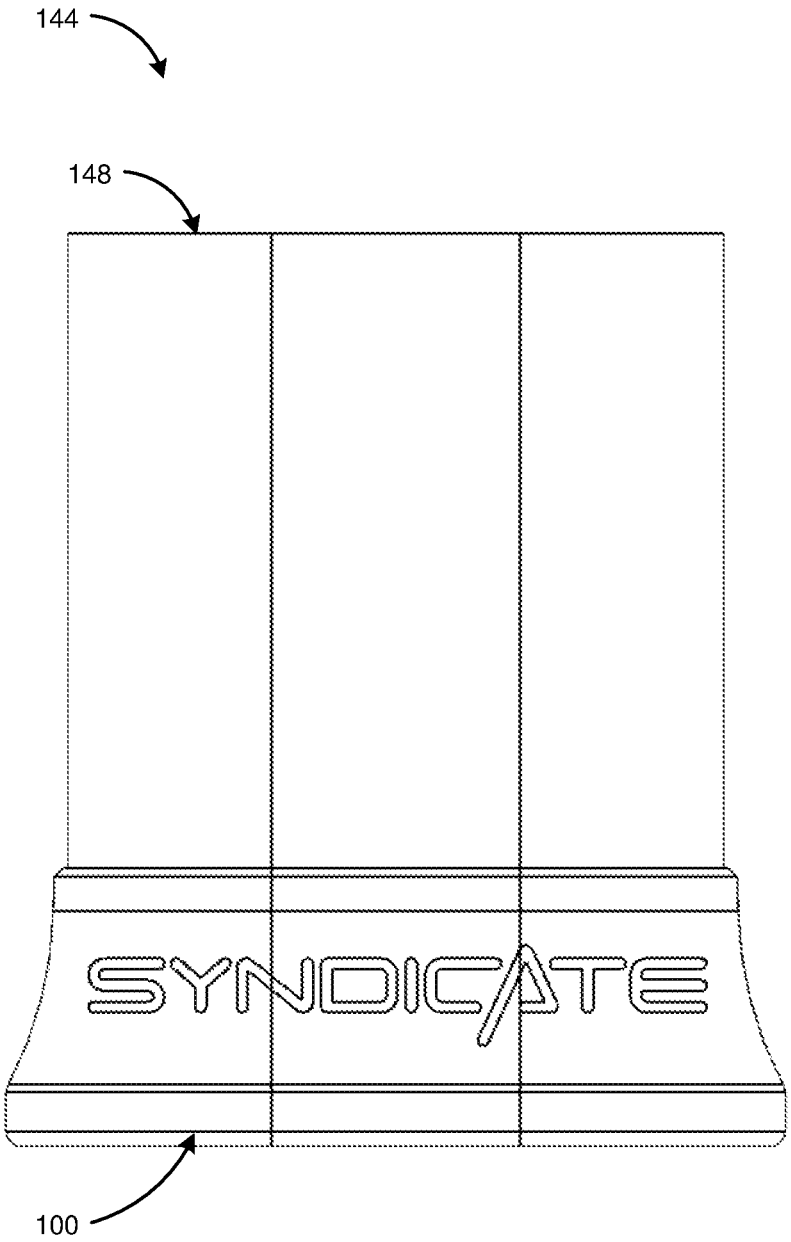
FIG. 2D depicts a front view of the magazine well in the attached configuration in accordance with one or more embodiments of the disclosure.
Figure 2E:
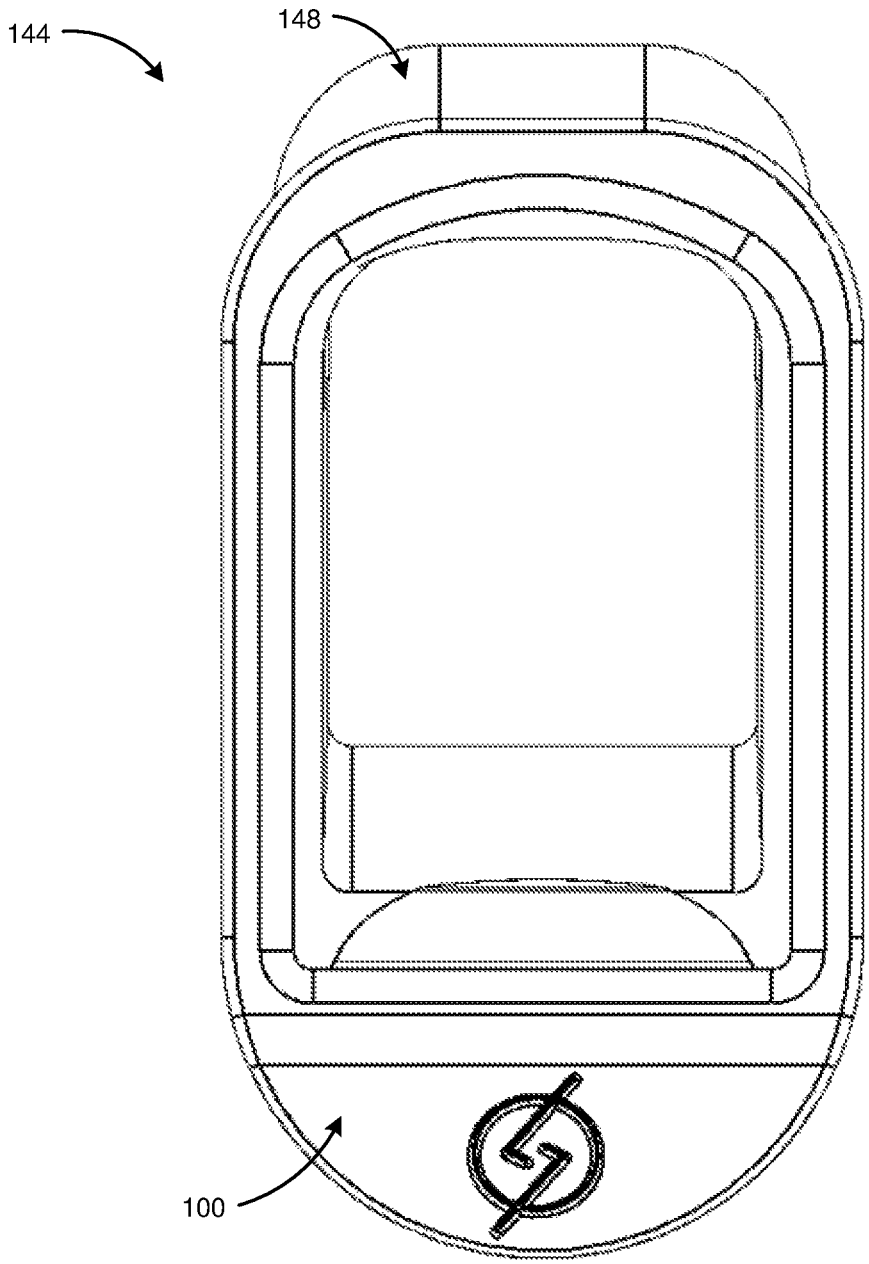
FIG. 2E depicts a bottom view of the magazine well in the attached configuration in accordance with one or more embodiments of the disclosure.

In some embodiments, as shown in FIG. 1H, the magazine well 100 includes a lip 142 extending along the base 102 perpendicular to the continuous wall 118. In one example, the lip 142 can be flat and protrudes from the distal end 106 towards the proximate end 104 of the base 102. The lip 142 can be substantially adjacent to the continuous wall 118. In some instances, the lip 142 abuts the firearm grip 148 (e.g., as shown in FIG. 2E). In certain examples, the lip 142 can extend only partially around the magazine aperture 116. In other examples, the lip 142 can extend the entire perimeter of the magazine aperture 116. The lip 142 can extend at an angle away from the base 102 and be any suitable shape configured to secure the base 102 of the firearm grip 148.

In some embodiments, as shown in FIGS. 1C-1G, the magazine well 100 includes a first tab 122 and a second pliable tab 132 configured to secure the magazine well 100 to the firearm grip 148 (e.g., as shown in FIG. 2A). In one example, the first tab 122 is adjacent to and spaced apart from the second pliable tab 132. Each tab can be disposed on the proximate end 104 of the magazine well 100 base 102. In other examples, the first tab 122 and the second pliable tab 132 are disposed on the distal end 106, the first side 108, or the second side 110. The first tab 122 and the second pliable tab 132 can extend away from the base 102. The height of the first tab 122 and the second pliable tab 132 may adjust according to the firearm grip. The first tab 122 and the second pliable tab 132 may be any suitable size, shape, or configuration. In certain embodiments, the magazine well 100 can include more than two tabs In some embodiments, as shown in FIGS. 1A and 1G, the first tab 122 includes a first tab fore surface 124, a first tab aft surface 126, and a first tab top surface 128. In one example, the first tab 122 can be a semicircular shape projecting from the base 102. The first tab fore surface 124 can be substantially arcuate. In other examples, the first tab fore surface 124 can be substantially flat. In some examples, the first tab aft surface 126 can include a ridge 130 projecting away from the first tab 122 towards the distal end 106. The ridge 130 can be configured to align with an interior surface of the firearm grip (not shown). In one example, the ridge 130 can substantially complement the arcuate first tab top surface 128. In other examples, the ridge 130 can be another geometric shape, such as rectangular, triangular, or square.

Figure 1I:
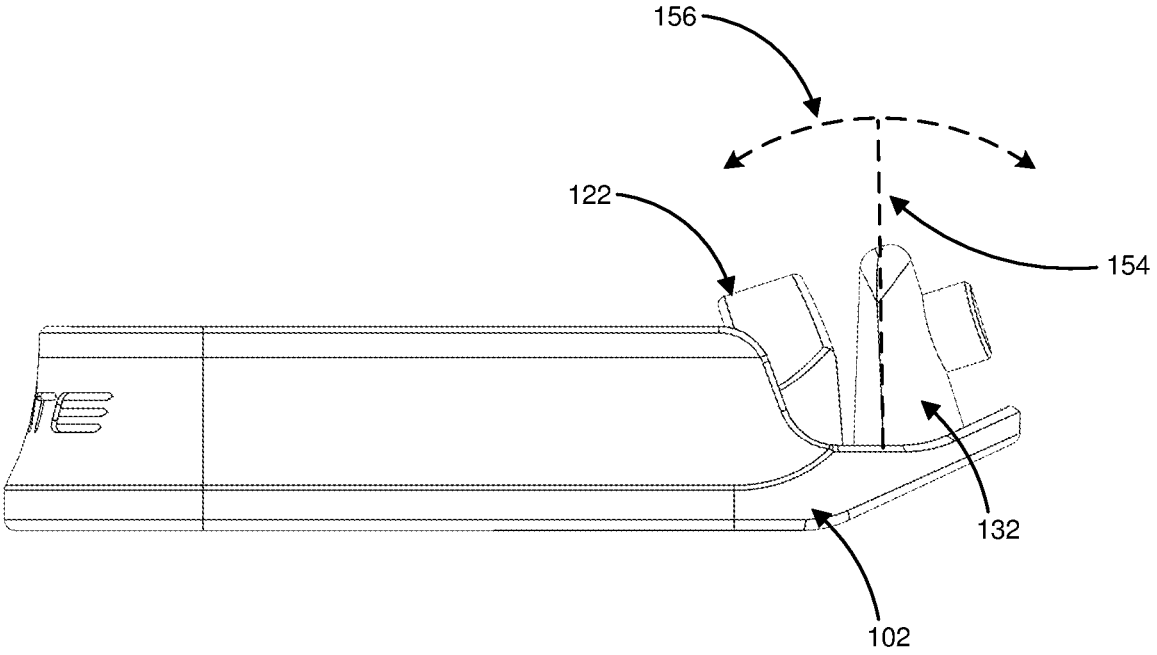
FIG. 1I depicts a side view of the magazine well in accordance with one or more embodiments of the disclosure.

In some embodiments, the second pliable tab 132 includes a second pliable tab fore surface 134, a second pliable tab aft surface 136, and a second pliable tab top surface 138. In one example, the second pliable tab fore surface 134 and the second pliable tab aft surface 136 are arcuate. In another example, the second pliable tab fore surface 134 and the second pliable tab aft surface 136 are substantially flat. The second pliable tab 132 can be flexibly configured to be inserted into a firearm grip 148. In some instances, the second pliable tab aft surface 136 includes a detent 140 configured to anchor the magazine well 100 into a notch 152 (e.g., as shown in FIG. 2C) in the firearm grip 148 (e.g., as shown in FIGS. 2A-2D). That is, the second pliable tab 132 can rotate, squish, and/or flexibly move in any direction to adjust and align the second pliable tab 132 with the firearm grip 148. Each component of the magazine well 100 can be flexible. In one example, as shown in FIG. 1I, the second pliable tab 132 can include a vertical axis 154 extending from the base 102. The second pliable tab 132 may rotate forward or backward about a semi-circular axis 156, perpendicular to the vertical axis 154. Similarly, the first tab 122 may rotate forward or backward along another axis. In another example, the detent 140 can include a flat outer surface and a circular side surface (e.g., cylindrically shaped). The detent 140 can protrude perpendicularly to the second pliable tab fore surface 134. In other examples, the detent 140 can protrude from the second pliable tab top surface 138 or the second pliable tab aft surface 136. In certain embodiments, the detent 140 can be pyramidal, rectangular, cubical, or some other geometric shape. The detent 140 may be any suitable size, shape, or configuration.

In some embodiments, as shown in FIGS. 1A and 1G, the magazine well 100 includes a channel 150 disposed between the first tab 122 and the second pliable tab 132. In some instances, the first tab fore surface 124 can face the second pliable tab aft surface 136 forming the channel 150 therebetween. The first tab fore surface 124 arc can complement the second pliable tab aft surface 136. Each surface, the first tab fore surface 124 and the second pliable tab aft surface 136, can be arcuate. The channel 150 can complement a wall of the firearm grip 148. The channel 150 can flexibly grip the firearm grip. That is, a wall of the firearm grip 148 may be sandwiched within the channel 150, which may apply a suitable pressure against the wall of the firearm grip 148.

In some embodiments, as shown in FIGS. 1A-2E, the magazine well 100 includes an engaged configuration 144 and a disengaged configuration 146. The magazine well 100 engaged configuration 144 includes the magazine well 100 being secured onto a firearm grip 148. In one example, the first tab 122, the second pliable tab 132, the lip 142, and the continuous wall 118 abut the firearm grip 148 in the engaged configuration 144. In one example, the first tab 122 and the second pliable tab 132 bodies can be flexible. In another example, the first tab 122 and the second pliable tab 132 can each be flexible about the base 102. The flexible second pliable tab 132 can be configured to operably adjust to slide within the grip 148 of the firearm. In this manner, the detent 140 can align and engage with a notch extending through the firearm grip 148, thereby securing the magazine well 100 onto the grip 148. In other examples, one or more of the aforementioned components can abut the firearm grip 148 to secure the magazine well 100 thereto.

In the engaged position 144, the detent 140 can secure the magazine well 100 to the firearm grip by being disposed within a notch in the firearm grip 148. In some instances, the detent 140 can secure onto a hook or some other attachment mechanism embedded in the firearm grip 148. Alternating from the engaged configuration 144 to the disengaged configuration 146 can include applying a force to the detent 140 extending through the firearm grip 148. The force applied to the detent 140 can push the flexible second pliable tab 132 and detent 140 back into the firearm grip. The magazine well 100 can then slide from within the firearm grip 148 into a detached configuration 146.

While various embodiments of the present disclosure have been described above, it should be understood that they have been presented by way of example only, and not limitation. It will be apparent to persons skilled in the relevant art that various changes in form and detail can be made therein without departing from the spirit and scope of the present disclosure. Thus, the breadth and scope of the present disclosure should not be limited by any of the above-described exemplary embodiments but should be defined only in accordance with the following claims and their equivalents. The foregoing description has been presented for the purposes of illustration and description. It is not intended to be exhaustive or to limit the present disclosure to the precise form disclosed. Many modifications and variations are possible in light of the above teaching. Further, it should be noted that any or all of the aforementioned alternate implementations may be used in any combination desired to form additional hybrid implementations of the present disclosure. For example, any of the functionality described with respect to a particular device or component may be performed by another device or component. Further, while specific device characteristics have been described, embodiments of the disclosure may relate to numerous other device characteristics. Further, although the embodiments have been described in language specific to structural features and/or methodological acts, it is to be understood that the disclosure is not necessarily limited to the specific features or acts described. Rather, the specific features and acts are disclosed as illustrative forms of implementing the embodiments. Conditional language, such as, among others, "can," "could," "might," or "may," unless specifically stated otherwise, or otherwise understood within the context as used, is generally intended to convey that certain embodiments could include, while other embodiments may not include, certain features, elements, and/or steps. Thus, such conditional language is not generally intended to imply that features, elements, and/or steps are in any way required for one or more embodiments.

What is claimed is:

1. A magazine well configured to be attached to a firearm, the magazine well comprising:

a base;

a flexible tab extending from the base;

a detent disposed on the flexible tab, wherein the detent is configured to engage a notch in the firearm in order to secure the magazine well to the firearm.

2. The magazine well of claim 1, wherein the base comprises a proximate end, a distal end, a first side, a second side, a top end, and an opposed bottom end, wherein a magazine aperture extends between the top end and the opposed bottom end, and wherein the magazine well further comprises:

a continuous wall projecting from the base along the first side, the distal side, and the second side;

a first tab disposed on the proximate end of the base, wherein the flexible tab comprises a second pliable tab disposed adjacent to the first tab; and a detent disposed on the second pliable tab.

3. The magazine well of claim 2, wherein the first tab comprises a first tab fore surface, a first tab aft surface, and a first tab top surface.

4. The magazine well of claim 3, wherein the first tab comprises a ridge projecting from the first tab aft surface.

5. The magazine well of claim 3, wherein the second pliable tab comprises a second pliable tab fore surface, a second pliable tab aft surface, and a second pliable tab top surface.

6. The magazine well of claim 5, wherein the first tab fore surface curvature complements the second pliable tab aft surface.

7. The magazine well of claim 2, further comprises a channel disposed between the first tab and the second pliable tab, wherein the channel is configured to receive a firearm grip between the first tab and the second pliable tab.

8. The magazine well of claim 2, further comprising a lip extending from the base substantially perpendicular to the continuous wall.

9. The magazine well of claim 8, further comprising an engaged configuration and a disengaged configuration, wherein in the engaged configuration a firearm grip is secured within the continuous wall, the first tab, and the second pliable tab, wherein in the disengaged configuration the firearm grip separates from the continuous wall, the first tab, and the second pliable tab.

10. The magazine well of claim 9, wherein the lip abuts the firearm grip in the engaged configuration.

11. The magazine well of claim 2, wherein the continuous wall comprises a bevel along an exterior surface.

12. A magazine well configured to be attached to a firearm, the magazine well comprising:

a base;

a wall projecting from the base;

an aperture formed between the base and the wall;

a flexible tab extending from the base, wherein the flexible tab comprises a first position and a second position; and a detent disposed on the flexible tab, wherein the flexible tab is moveable to the first position to attach the magazine well to the firearm, and wherein the flexible tab is movable to the second position to maintain the detent within a notch in the firearm in order to secure the magazine well to the firearm.

13. A magazine well, comprising:

a base with a proximate end, a distal end, a first side, a second side, a top end, and an opposed bottom end, wherein a magazine aperture extends between the top end and the opposed bottom end;

a continuous wall projecting from the base along the first side, the distal side, and the second side;

a first tab disposed on the proximate end of the base;

a second pliable tab disposed adjacent to the first tab; and a detent disposed on the second pliable tab.

14. The magazine well of claim 13, wherein the first tab comprises a first tab fore surface, a first tab aft surface, and a first tab top surface.

15. The magazine well of claim 14, wherein the first tab comprises a ridge projecting from the first tab aft surface.

16. The magazine well of claim 14, wherein the second pliable tab comprises a second pliable tab fore surface, a second pliable tab aft surface, and a second pliable tab top surface.

17. The magazine well of claim 16, wherein the first tab fore surface curvature complements the second pliable tab aft surface.

18. The magazine well of claim 13, further comprises a channel disposed between the first tab and the second pliable tab, wherein the channel is configured to receive a firearm grip between the first tab and the second pliable tab.

19. The magazine well of claim 13, further comprising a lip extending from the base substantially perpendicular to the continuous wall.

20. The magazine well of claim 19, further comprising an engaged configuration and a disengaged configuration, wherein in the engaged configuration a firearm grip is secured within the continuous wall, the first tab, and the second pliable tab, wherein in the disengaged configuration the firearm grip separates from the continuous wall, the first tab, and the second pliable tab.

* * * * *